US009125491B2

(12) United States Patent
Rehage

(10) Patent No.: US 9,125,491 B2
(45) Date of Patent: Sep. 8, 2015

(54) PULL-OUT GUIDE FOR FURNITURE OR HOUSEHOLD APPLIANCES

(75) Inventor: Daniel Rehage, Bielefeld (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 309 days.

(21) Appl. No.: 13/641,160

(22) PCT Filed: Apr. 13, 2011

(86) PCT No.: PCT/EP2011/055756

§ 371 (c)(1), (2), (4) Date: Oct. 15, 2012

(87) PCT Pub. No.: WO2011/131524

PCT Pub. Date: Oct. 27, 2011

(65) Prior Publication Data

US 2013/0034318 A1 Feb. 7, 2013

(30) Foreign Application Priority Data

Apr. 22, 2010 (DE) ..... 10 2010 016 594

(51) Int. Cl.

*A47B 88/00* (2006.01)
*A47B 88/10* (2006.01)
*A47B 88/04* (2006.01)

(52) U.S. Cl.

CPC ..... *A47B 88/10* (2013.01); *A47B 88/047* (2013.01)

(58) Field of Classification Search

CPC ..... A47B 88/047
USPC ..... 312/333, 334.6, 334.2, 334.27, 334.4, 312/334.7, 334.1
See application file for complete search history.

(56) References Cited

U.S. PATENT DOCUMENTS

| | | | | | |
|---|---|---|---|---|---|
| 2,343,692 | A * | 3/1944 | Miller | 312/334.13 |
| 4,072,375 | A * | 2/1978 | Boone | 312/334.8 |
| 5,757,109 | A * | 5/1998 | Parvin | 312/334.11 |
| 6,685,288 | B1 * | 2/2004 | MacMillan | 312/334.46 |
| 6,866,352 | B2 * | 3/2005 | Fujii et al. | 312/122 |
| 7,399,041 | B2 * | 7/2008 | Prentner et al. | 312/333 |
| 2004/0000851 | A1 * | 1/2004 | Lam Harn et al. | 312/334.7 |
| 2009/0058242 | A1 * | 3/2009 | Holcomb | 312/334.29 |
| 2009/0251038 | A1 * | 10/2009 | Yu et al. | 312/351.1 |

FOREIGN PATENT DOCUMENTS

| | | | |
|---|---|---|---|
| DE | 198 46 778 | | 4/1999 |
| DE | 199 44 654 | | 3/2001 |
| DE | 20 2006 000 519 | | 6/2006 |
| DE | 10 2006 037 324 | | 7/2007 |
| DE | 20 2008 010 580 | | 1/2010 |
| EP | 2466047 | A1 * | 6/2012 |
| WO | 2005/044047 | | 5/2005 |

OTHER PUBLICATIONS

German Office Action for Application No. 10 2010 016 594.8, dated Apr. 22, 2010.

* cited by examiner

*Primary Examiner* — Matthew Ing
*Assistant Examiner* — Andres F Gallego
(74) *Attorney, Agent, or Firm* — Barnes & Thornburg LLP

(57) ABSTRACT

A pull-out guide for furniture or household appliances includes a guide rail mountable on a body of the furniture or the household appliance, a central rail displaceably mounted on the guide rail, and a running rail displaceably mounted on the central rail. The central rail includes a double profile formed as a trapezoid along a displacement direction of the central rail.

11 Claims, 14 Drawing Sheets

PULL-OUT GUIDE FOR FURNITURE OR HOUSEHOLD APPLIANCES

CROSS-REFERENCE TO RELATED APPLICATION

This application is a national stage of International Application PCT/EP2011/055756, filed Apr. 13, 2011, and claims benefit of and priority to German Patent Application No. 10 2010 016 594.8, filed Apr. 22, 2010, the content of which Applications are incorporated by reference herein.

BACKGROUND AND SUMMARY

The present disclosure relates to a pull-out guide for furniture or household appliances. The pull-out guide includes a guide rail configured to be mounted on a body of the furniture or the household appliance, a central rail displaceably mounted on the guide rail, and a running rail displaceably mounted on the central rail.

Generic pull-out guides for furniture or household appliances are known in numerous embodiments from the state of the art. They comprise a guide rail which can be mounted on a body of the furniture or household appliance, a central rail which is movably mounted in relation to the guide rail, and a running rail which is movably mounted in relation to the central rail, thereby producing smooth mobility of a sliding element to be moved in relation to the body of the furniture or the household appliance, for example, a drawer or a cooking item carrier. The known pull-out guides are regularly provided with self-retraction apparatuses for increasing the convenience of the furniture or the household appliance provided with such a pull-out guide. The self-retraction apparatuses will automatically and completely retract the component to be moved to an end position in the furniture or the domestic appliance after the partial retraction of the component.

Such self-retraction apparatuses frequently consist of finely structured mechanical components which are susceptible to soiling. These apparatuses are partially not heat-resistant and are therefore not suitable for installation in an oven due to the heat prevailing therein and the splashes or crumbs of the cooking item which will contaminate the self-retraction apparatuses.

Embodiments of the present disclosure provide for a pull-out guide for furniture or household appliances with a self-retraction function which can be used in a wider field of applications.

The present disclosure thus relates to a pull-out guide for furniture or household appliances. The pull-out guide includes a guide rail configured to be mounted on a body of the furniture or the household appliance, a central rail displaceably mounted on the guide rail, and a running rail displaceably mounted on the central rail. The central rail is configured to include a double profile that is formed as a trapezoid along a displacement direction of the central rail.

In accordance with an embodiment of the present disclosure, the central rail of the pull-out guide is arranged as a double profile which is formed trapezoidally in a displacement direction of the pull-out guide. As a result, the pull-out guide, after the partial insertion in a direction of its end position, will move automatically to its end position by the guide rail which is mounted with a descending gradient on the furniture or appliance body without being driven by a spring or similar device. The sliding element remains in the horizontal position over the entire path of displacement of the pull-out guide. Alternatively, within the scope of the present disclosure, the descending gradient can also be used in an opposite way in order to provide an opening apparatus for a sliding element. As a result of the configuration of the pull-out guide, in accordance with the present disclosure, a considerably longer self-retraction path is achieved as compared with the self-retraction apparatuses as known from the state of the art.

Embodiments of the present disclosure are discussed herein, including the in appended claims.

In accordance with one embodiment of the present disclosure, the central rail includes two profiles which are respectively movable in the running rail and the guide rail and of a section which is shaped in a trapezoidal manner and connects the profiles with one another. The width of the section at one end, which is at the rear as seen in the pull-out direction, is larger than the width of the section at a front end of the section. A central rail arranged in this manner can be produced easily, for example, it can be bent from one single piece of sheet metal and it is highly resistant to soiling in its assembly with the guide rail or the running rail.

Alternatively, within the scope of the present disclosure, a pull-out guide can also be made of two partial pull-out guides which are connected with one another at a desired angle. Partial pull-out guides may, for example, include two rails, that is, a guide rail and a running rail. The rails may be advantageously connected with one another via a trapezoidal central piece. In this case, the guide rail is fixed to the body and the a running rail is fixed to a sliding element.

In accordance with a further embodiment according to the present disclosure, the pull-out guide includes a blocking arrangement with which the running rail can be blocked in relation to the central rail at least over a portion of the pull-out path of the pull-out guide. In this respect, the blocking arrangement may, for example, include a locking element which can be fastened to the central rail, a latching element which can be fastened to the running rail, and a control element which can be fixed to the guide rail. The locking element can be latched with or unlatched from the latching element when moving over the control element. A sequence control of the pull-out or insertion process is simply enabled with such a blocking arrangement.

The locking element may, for example, be arranged or configured as a ratchet pawl which can be latched together with a latching element arranged as a detent lug. As a result, the running rail can be blocked with the middle rail during a first phase of pulling out the furniture part to be moved, with the ratchet pawl being latched behind the detent lug of the running rail.

During further pulling out, the ratchet pawl will then be lifted in the end position of the middle rail by a control element which may, for example, be arranged or configured as a ramp and is arranged on the guide rail. The running rail is unlocked and the ratchet pawl is latched behind the ramp, and the guide rail and central rail being locked with one another.

During a subsequent renewed insertion of the movable furniture part, the ratchet pawl will then be lifted by the detent lug on the running rail and will thereby release the central rail. In the state thus blocked with the running rail, the central rail will automatically move to its end position as a result of the trapezoidal configuration of the central rail and as a result of the guide rail which is arranged with a descending gradient in the direction of the rear wall of the furniture or household appliance.

In accordance with another embodiment of the present disclosure, a stop damper is provided at the end of the guide rail which is a rear end as seen from the pull-out direction. As a result, an impact noise of the central rail on the guide rail can be dampened or even avoided entirely during the automatic retraction of the central rail to its end position. Furthermore, a strong impact of the central rail on the guide rail caused, for example, by powerful acceleration of the movable furniture part into the body of the furniture or the household appliance can be dampened in order to prevent damage to components.

In accordance with another embodiment of the present disclosure, a pull-out guide includes a guide rail configured to be mounted on a furniture or appliance body, a central rail which is movably mounted on the guide rail via first sliding surfaces or running surfaces for rolling bodies, and a running rail which is movably mounted on the central rail via second sliding surfaces or running surfaces for rolling bodies. The first sliding surfaces or running surfaces for rolling bodies is aligned in an inclined manner, at least in sections, in relation to the second sliding surfaces or running surfaces for rolling bodies. The inclination of the first and second sliding surfaces or running surfaces may, for example, be in a range of between 1° and 15°, or, for example, in the range of 5° to 10°. The inclination can, for example, extend over an entire length of the sliding or running surfaces. The number of rolling bodies and their shape can, for example, be chosen based on the weight load to be expected.

Other aspects of the present disclosure will become apparent from the following descriptions when considered in conjunction with the accompanying drawings.

DETAILED DESCRIPTION

Figure 1:
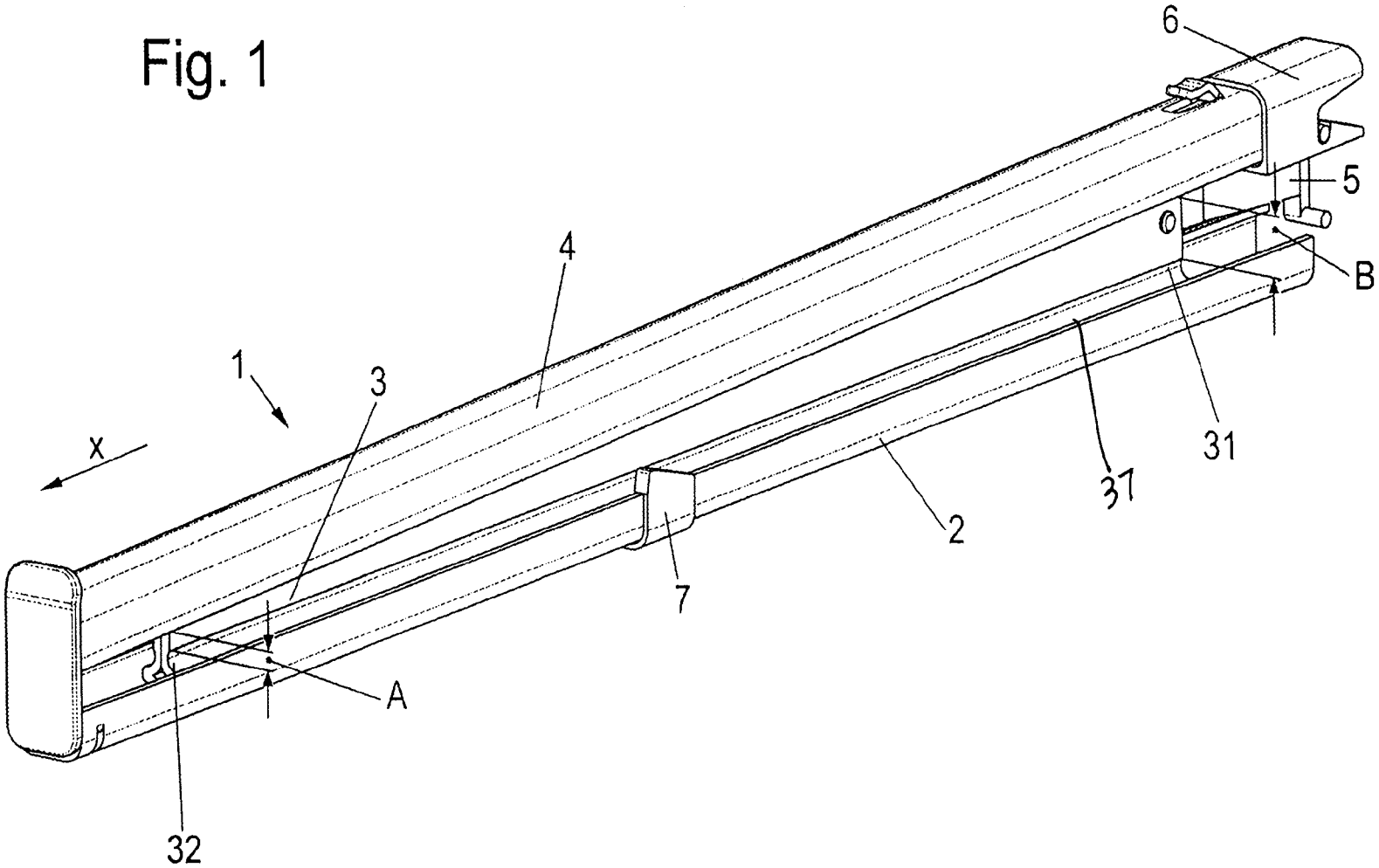
FIG. 1 shows a perspective view of an embodiment of a pull-out guide, in accordance with the present disclosure.

In the description provided herein, the terms such as above, below, left, right, front, and rear, for example, relate to the pull-out guide and other elements as shown in the drawings. These terms shall not be understood as being limiting in any way, which means such term references can change by, for example, different working positions or mirror-symmetrical configurations.

The pull-out guide 1, as shown, for example, in FIG. 1, includes a guide rail 2 which can be mounted on a furniture body or a body of a household appliance such as an oven, for example, a running rail 4 which can be arranged or is configured to be mounted on a movable furniture or household appliance part, such as a drawer or other sliding element, such as a baking sheet or a grating, for example. The running rail 4 is mounted via rolling bodies (not shown) on a central rail 3 via first sliding or running surfaces 38 which central rail 3 is also movably mounted via rolling bodies on the guide rail 2 via sliding or running surfaces 37.

As is shown in the figures, the central rail 3 is arranged as or configured to include a double profile, which double profile is trapezoidal in a direction of displacement of a pull-out direction x. The central rail 3 includes a profile 36 which is displaceable in the running rail 4, a profile 34 which is displaceable in the guide rail 2, and a section 35 which connects the profiles 34, 36 with one another and which is trapezoidal or shaped in the manner of a trapezoid.

A width B of the section 35 is larger at a rear end 31 which rear end 31 is as seen in FIG. 1 away from the pull-out direction x than a width A of the section 35 located at a front end 32. The trapezoidally shaped section 35 may, for example, be arranged as a web, but can, within the scope of the present disclosure, also be arranged as a web provided with gaps such as a perforated plate.

The guide rail 2 is installed in the body of the furniture or domestic appliance in a downwardly inclined manner against the pull-out direction x. The descending gradient of the guide rail 2, in a state when installed in the furniture or household appliance body, is dimensioned in such a way that the running rail 4 is configured to be displaced on the trapezoidally-shaped central rail 3 at least in an approximately horizontal manner.

Figure 2:
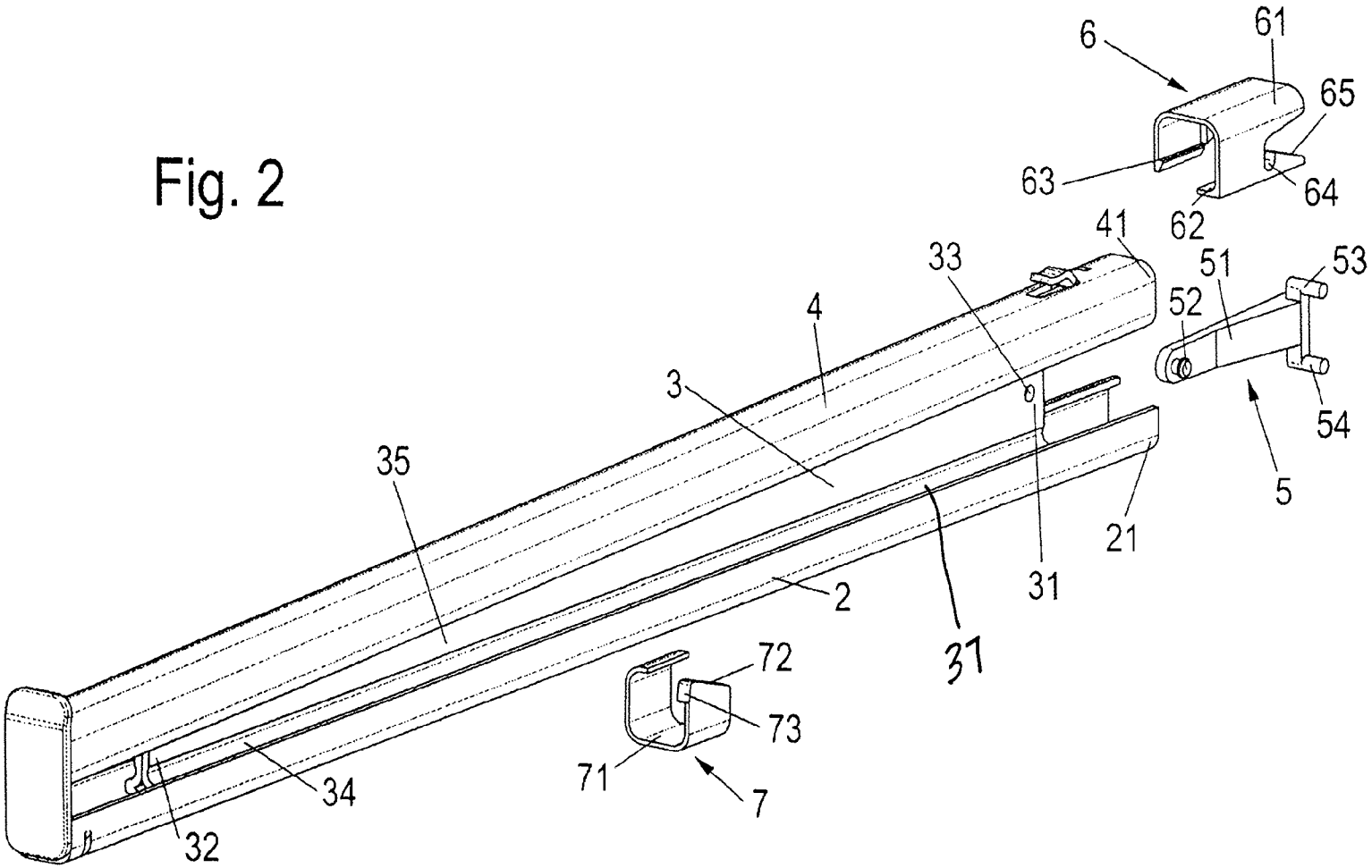
FIG. 2 shows an exploded view of the pull-out guide of FIG. 1.

For the sequence control of a pull-out or insertion process, the pull-out guide 1 includes a blocking arrangement with which the running rail 4 is configured to be blocked in relation to the central rail 3 at least during a part of a pull-out path of the pull-out guide 1. As is shown in FIG. 2, the blocking arrangement includes a locking element 5 configured to be fastened to the central rail 3, a latching element 6 configured to be fastened to the running rail 4, and a control element 7 configured to be fastened to the guide rail 2. The locking element 5 is configured and arranged in such a way that when it moves over the control element 7 arranged on the guide rail 2 it can be latched into or unlatched from latching element 6 fixed to the running rail 4.

The locking element 5 may, for example, be arranged as a ratchet pawl which, as shown in the embodiment of FIG. 2, is rotatably fixed to the central rail 3. Alternatively, within the scope of the present disclosure, the ratchet pawl may be arranged to be vertically displaceable. For this purpose, the locking element 5 may include a web-like base body 51, on which a pin 52 is provided. The pin 52 may be arranged horizontally and perpendicularly to the pull-out direction x at its end which faces in the pull-out direction x in the mounted state. The pin 52 penetrates a borehole 33 at the end 31 of the central rail 3, which end 31 is the rear end as seen in the pull-out direction x. This is so that the locking element 5 is pivotably suspended in a plane parallel to the wall of the furniture or appliance body on which the guide rail 2 is mounted. Two pins 53, 54, which are arranged perpendicularly above one another, are arranged, and especially formed, at the end of the locking element 5 which is at a rear of locking element 5 as seen from the pull-out direction x. The upper pin 53, which is the one closer to the running rail 4, is used for latching the latching element 6 which is arranged on the running rail 4. The bottom pin 54, which is closer to the running rail 2, is used for the upward and downward movement of the locking element 5 by interaction with the control element 7 fixed to the guide rail 2. It is within the scope of the present disclosure to provide an arrangement of the locking element 5 on the central rail 3 via a spring element.

The latching element 6 has a base body 61 which is adjusted to the outer contour of the running rail 4 and partly engages over the running rail 4. The base body 61 can be slid onto the running rail 4 from the rear end 41 of the running rail 4 for mounting on the running rail 4 from the end 41 which is a rear end as seen from the pull-out direction x. The base body 61 is held on the running rail 4 with guide webs 62, 63 formed on the base body 61. A latching groove 64 is formed in the region of a side wall of the base body 61, into which the upper pin 53 of the locking element 5 can enter via a ramp 65 of the base body 61 of the latching element 6. The state of the pull-out guide 1, as shown in FIGS. 5 and 6, is in its end position and in which the running rail 4 is latched together with the central rail 3 with the help of the latching element 6 and the locking element 5.

The functionality of the pull-out guide 1 during the pull-out and insertion of the movable furniture or household appliance part to be actuated via the pull-out guide 1 is explained below by reference to FIGS. 7 to 14.

Figure 5:
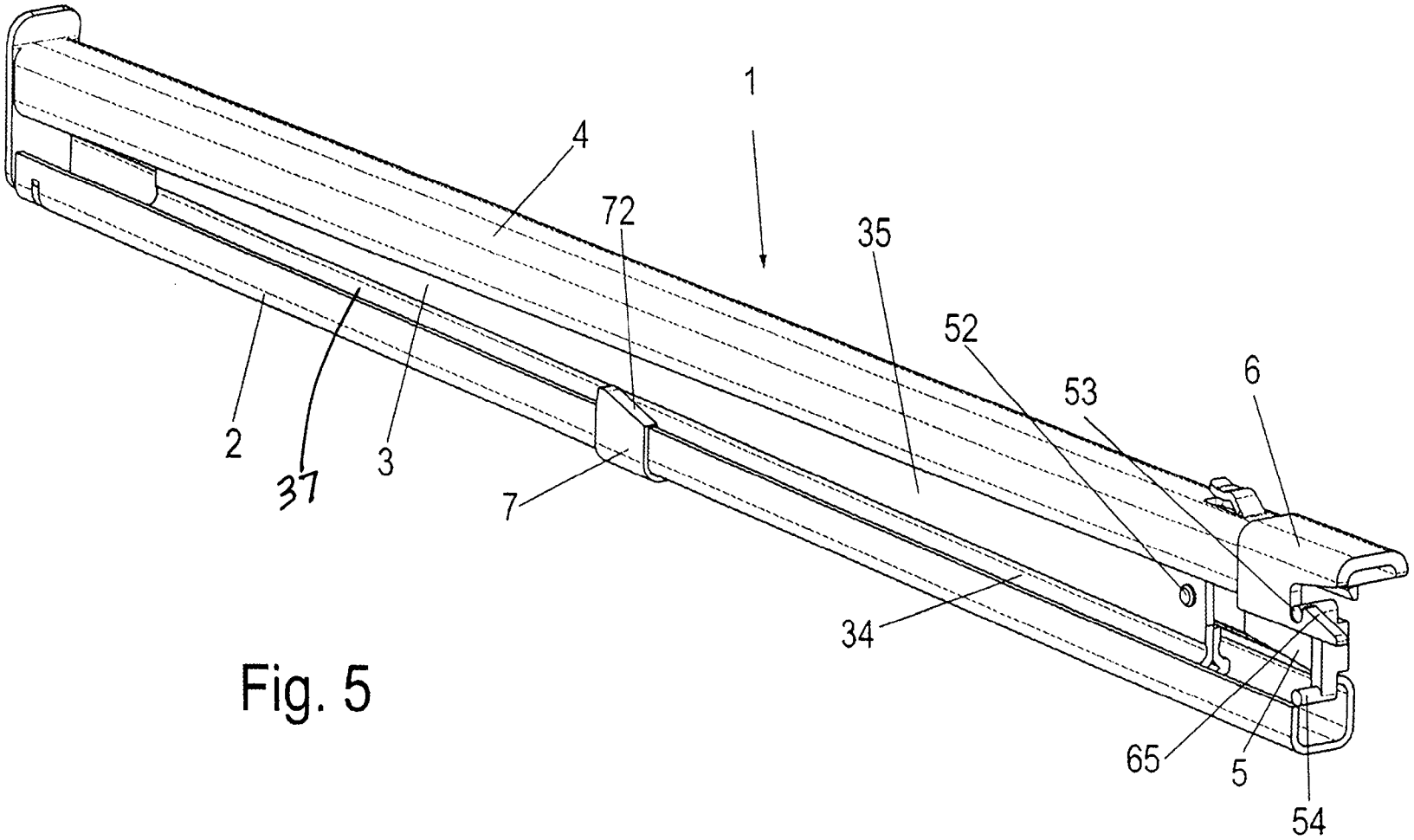
FIG. 5 shows a further perspective view of the pull-out guide of FIG. 1.
Figure 6:
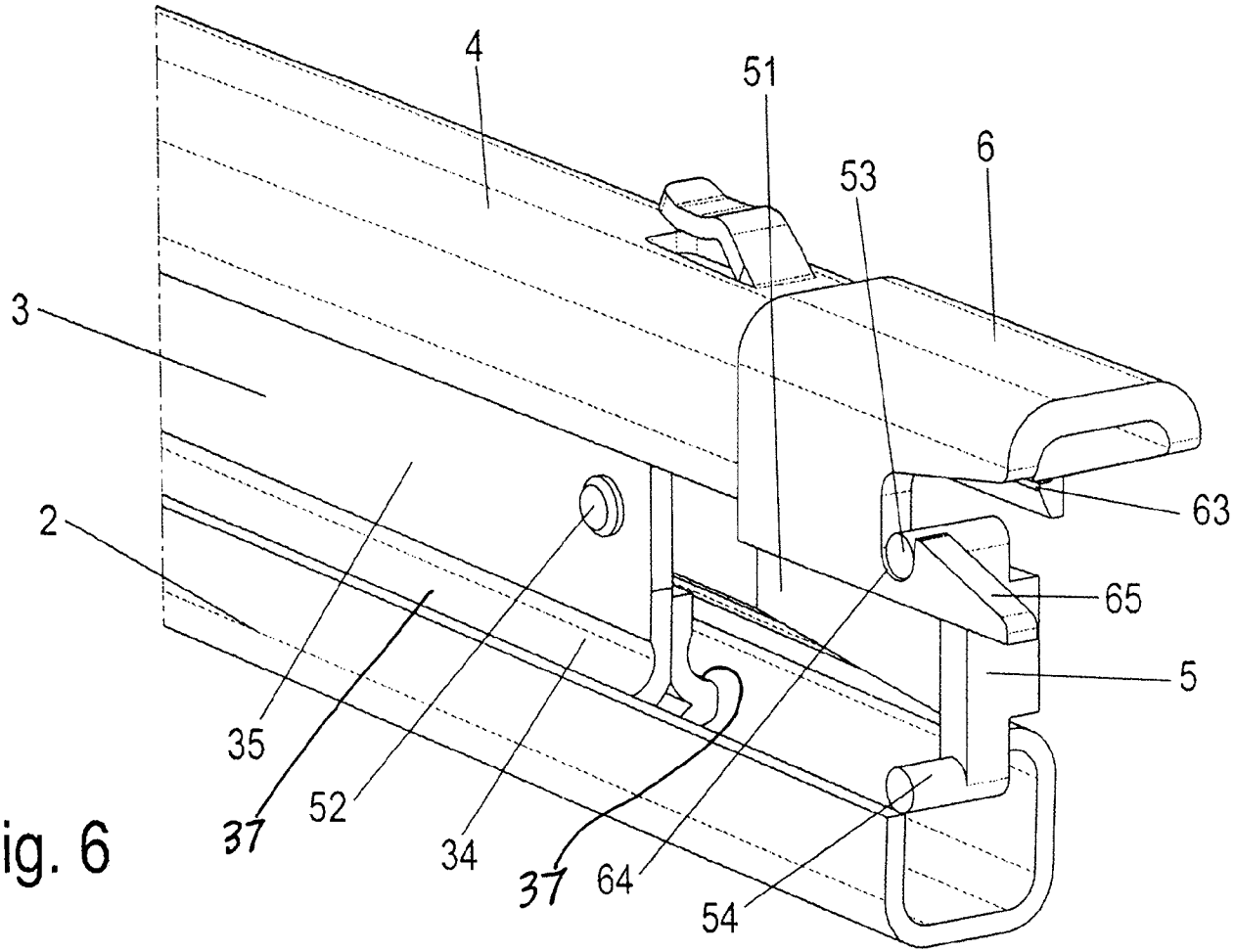
FIG. 6 shows a perspective, detailed view of an end region of the pull-out guide of FIG. 1, including a blocking arrangement.
Figure 7:
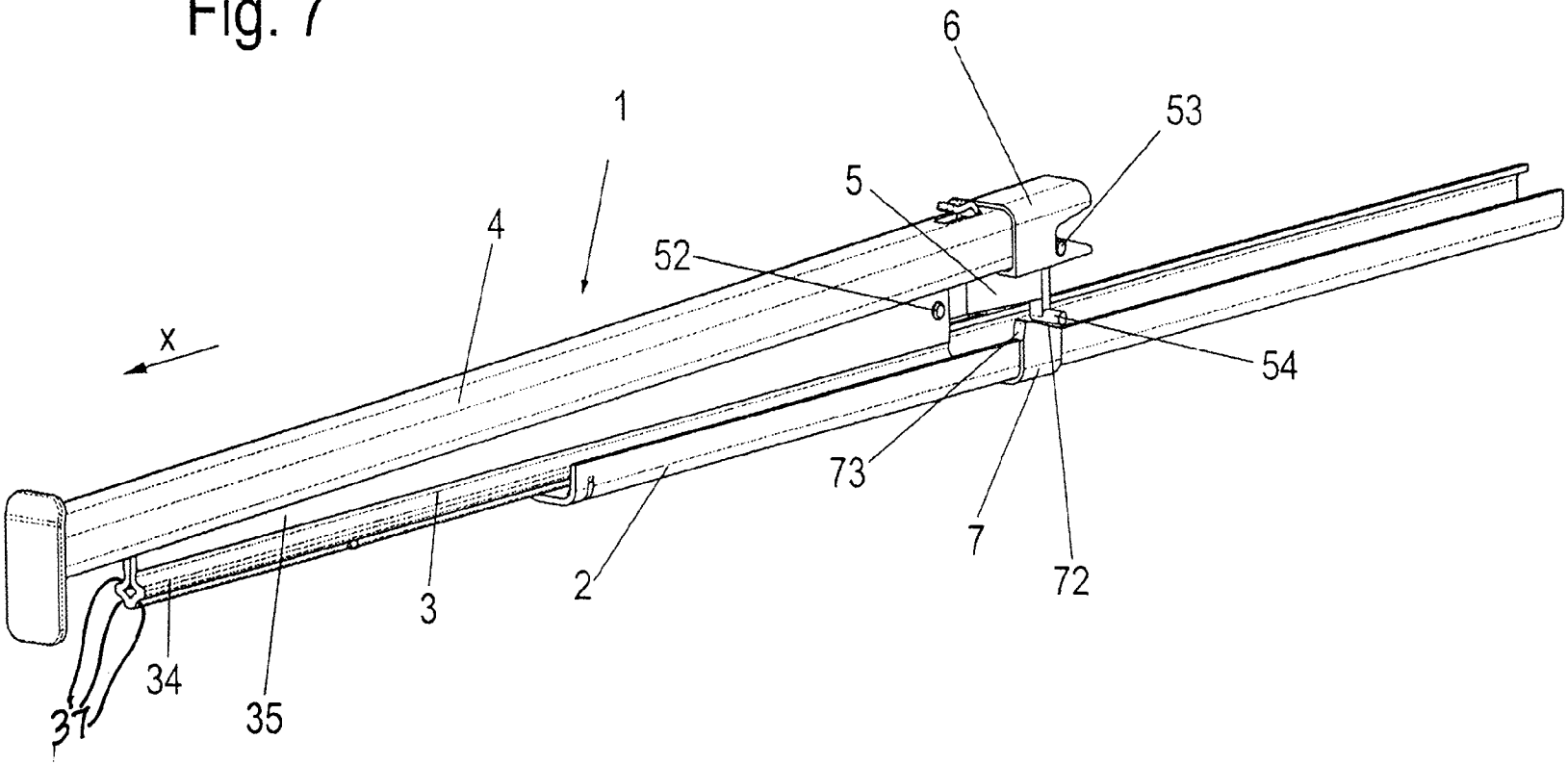
FIGS. 7 to 14 show different views of the pull-out guide of FIG. 1, including different extended positions of the central rail and the running rail.
Figure 8:
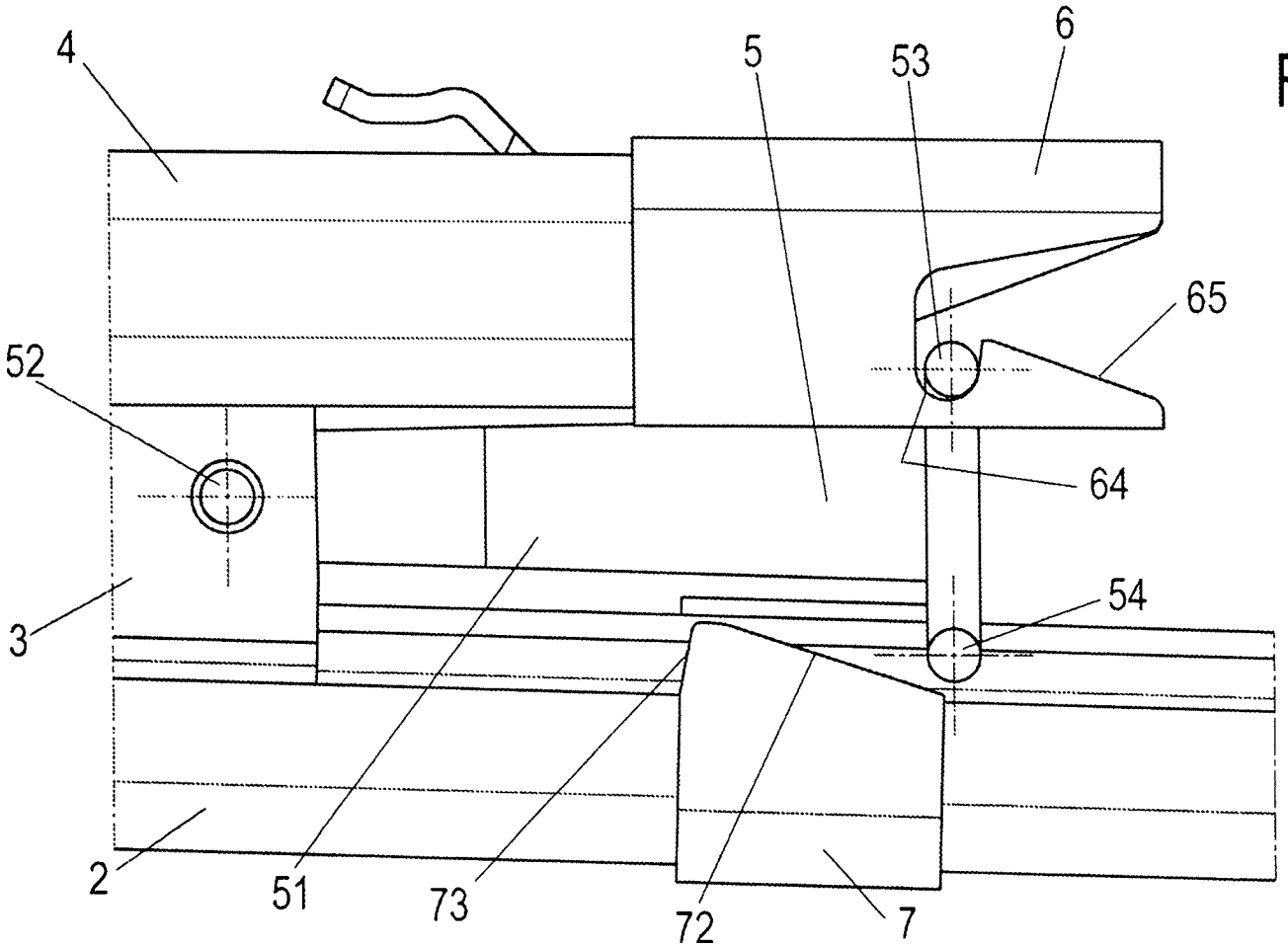

The end position of the pull-out guide 1, as shown in FIGS. 5 and 6, will be regarded as the initial state in which the movable furniture or household appliance part is inserted completely into the furniture or household appliance body. In this state, the upper pin 53 of the locking element 5 rests in the latching groove 64 of the latching element 6. As a result, the central rail 3 is locked together with the running rail 4.

During a first phase of a pull-out, the running rail 4 remains in the locked state with the central rail 3, so that the running rail 4 will move together with the running rail 3 in relation to the guide rail 2 in the pull-out direction x. Shortly before reaching the maximum pull-out path of the central rail 3 in relation to the guide rail 2, the bottom pin 54 of the locking element 5 meets the control element 7 which is fixed in this position to the guide rail 2. The locking element 5 can be arranged in a spring-loaded manner.

The control element 7 includes a base body 71 (see FIG. 2) which engages at least partly around the guide rail 2 from below, that is, the side facing away from the central rail 3 and the running rail 4. Alternatively, the control element 7 can, within the scope of the present disclosure, be arranged integrally with the guide rail 2. One of the side walls of the base body 71 includes two face surfaces 72, 73 which are arranged in the manner of ramps, with the ramp 72 being provided with an ascending gradient, as seen in the pull-out direction x, and converging into the ramp 73 which slopes downwardly in a steep manner in the pull-out direction x.

Figure 9:
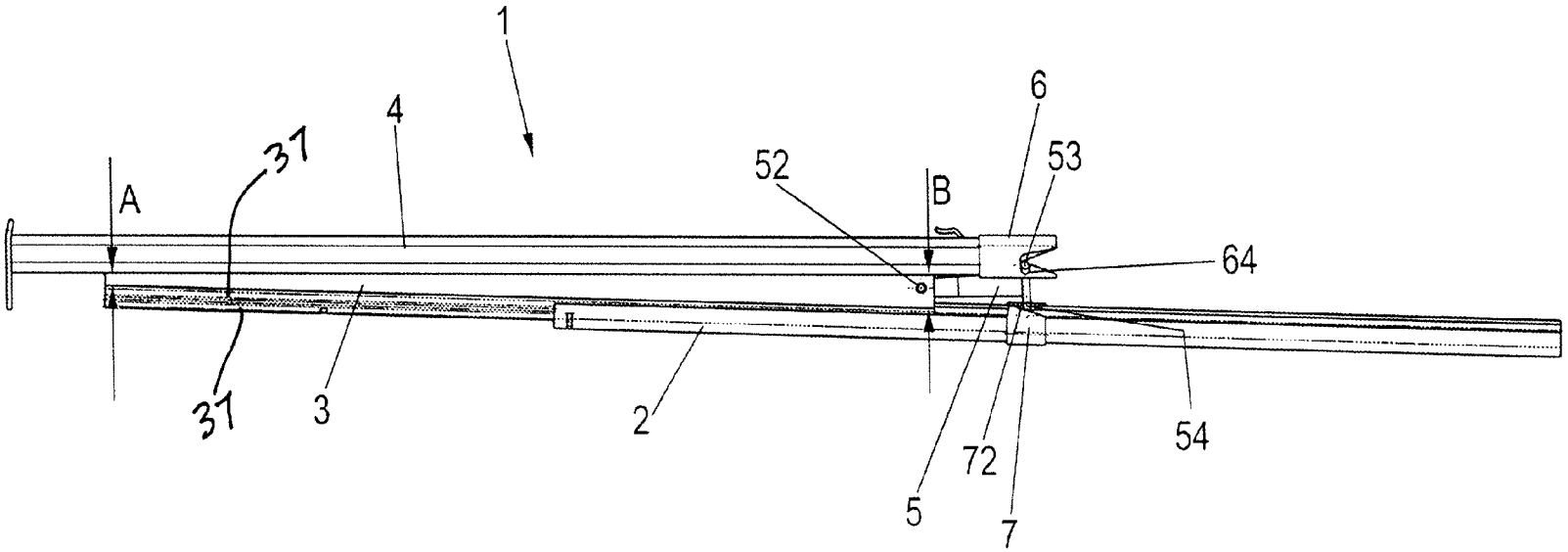
Figure 10:
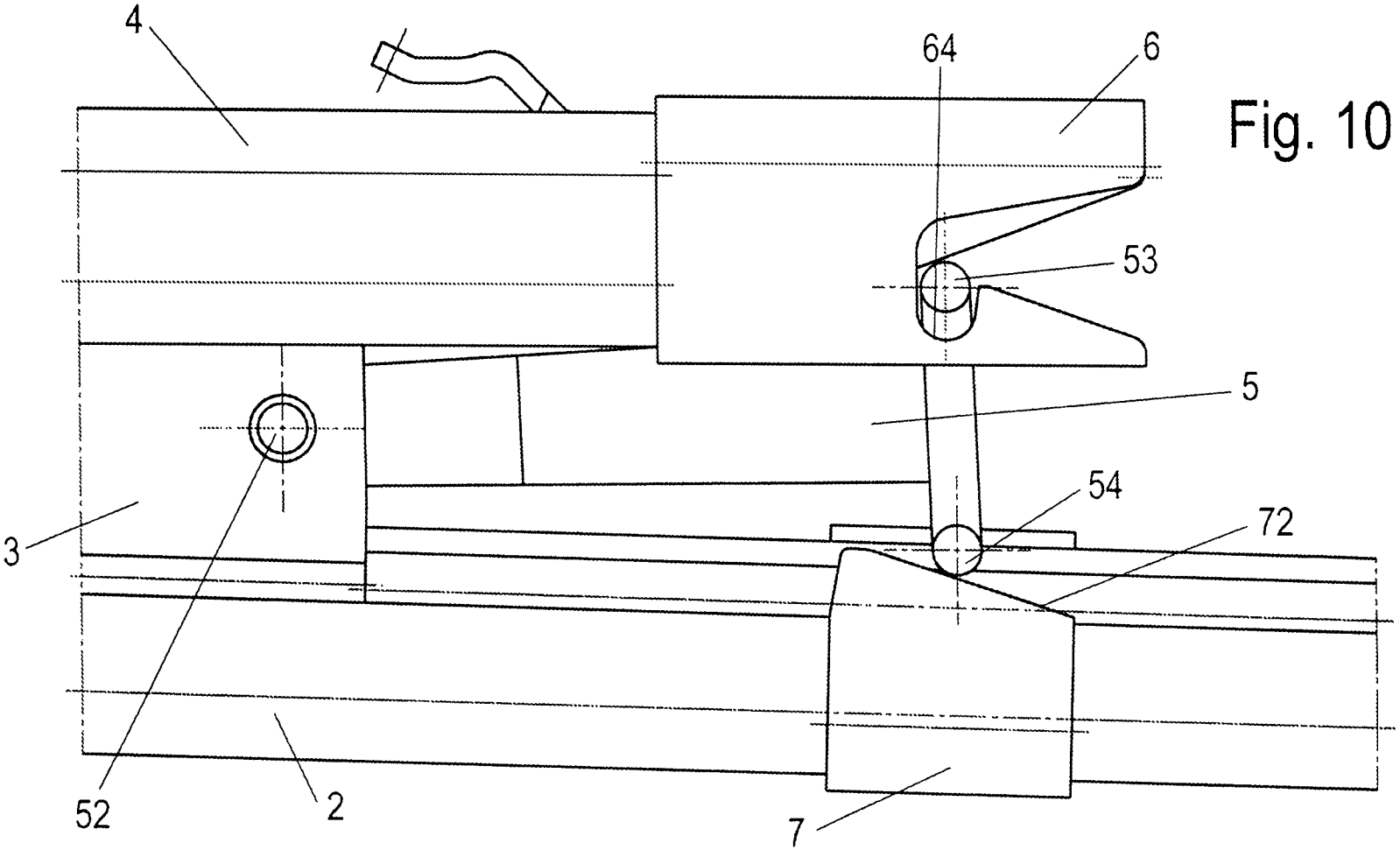
Figure 11:
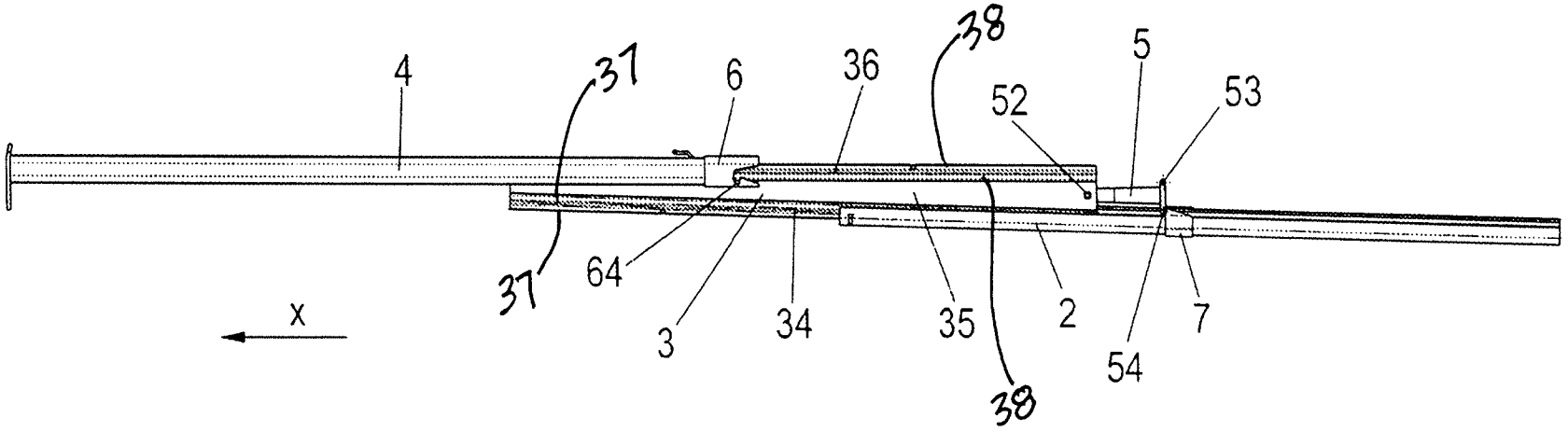
Figure 12:
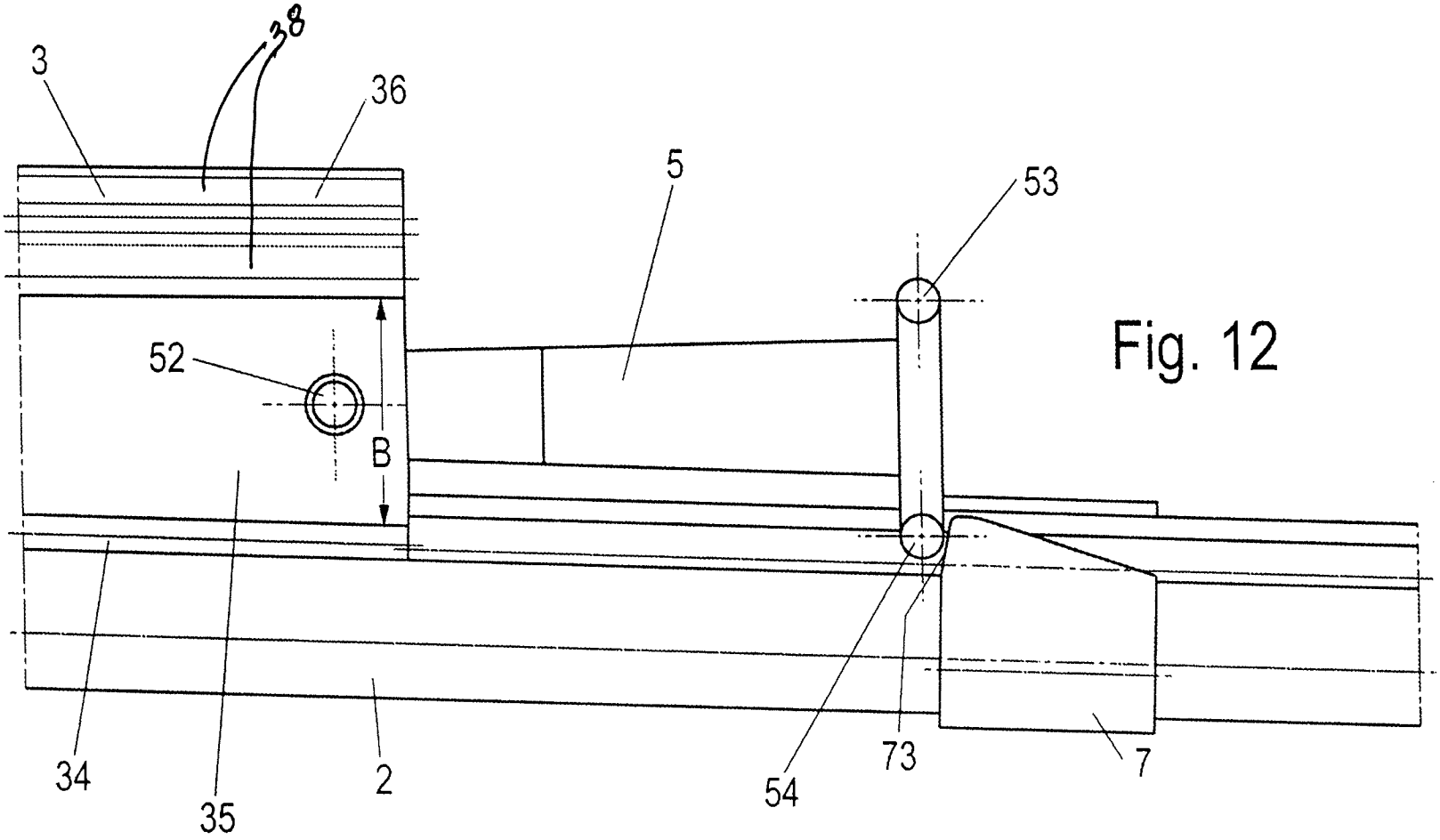

Once the pin 54 of the locking element 5 reaches the ramp 72 of the control element 7, as shown in FIGS. 9 and 10, the locking element 5 will be lifted at an end, which is a rear end as seen from the pull-out direction x, during the further displacement of the central rail 3 in the pull-out direction x. The upper pin 53 is lifted out of the latching groove 64 of the latching element 6 and thereby releases the running rail 4 from its locking with the central rail 3. Finally, the locking element 5, which is arranged as a ratchet pawl, rests behind the ramp 7, that is, before the ramp 7, as seen from the pull-out direction x, and thereby locks the guide rail 2 with the central rail 3. The running rail 4 can be pulled out in this state to the maximum pull-out length in relation to the central rail 3. Such a state is shown in FIGS. 11 and 12. As a result of gravity acting on the pull-out guide 1, the central rail 3 tends to travel down the guide rail 2. As a result of the contact of the locking element 5 with the bottom pin 54 on the ramp 7 in the closing direction, the central rail 3 will be prevented to do so for such a time until the locking is released by retraction of the running rail 4. After the release of the locking, the running rail 4 and the central rail 3 jointly travel down the guide rail 2. The self-retraction path is, therefore, a path on the guide rail 2 between the control element 7 and a limit stop in the guide rail 2.

Figure 13:
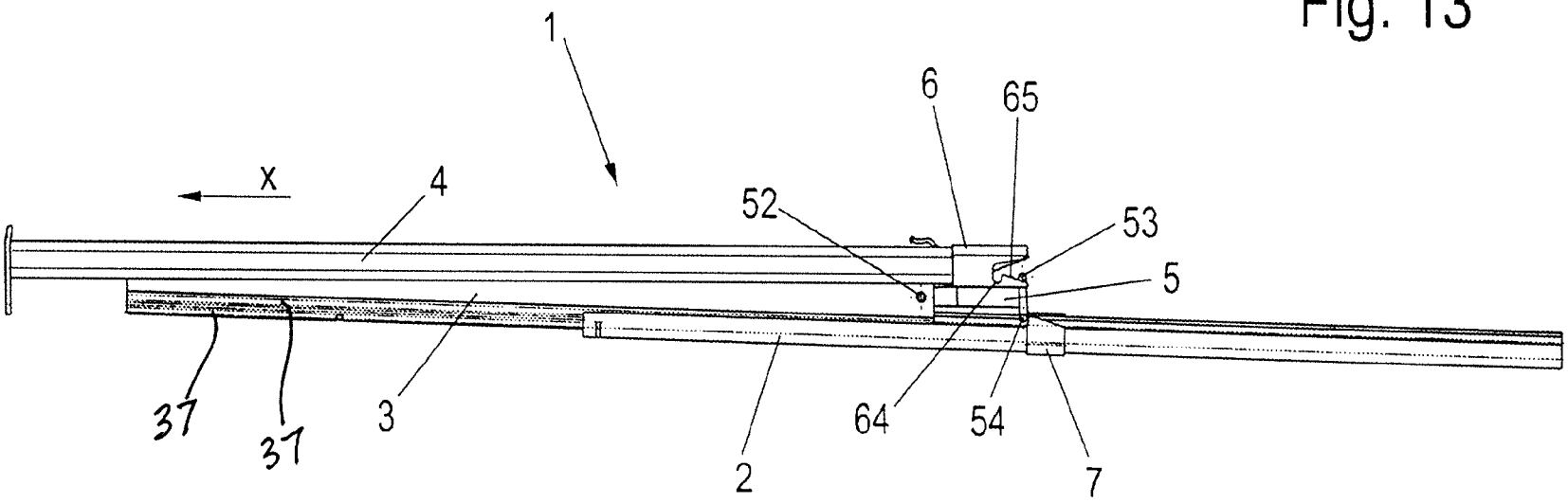
Figure 14:
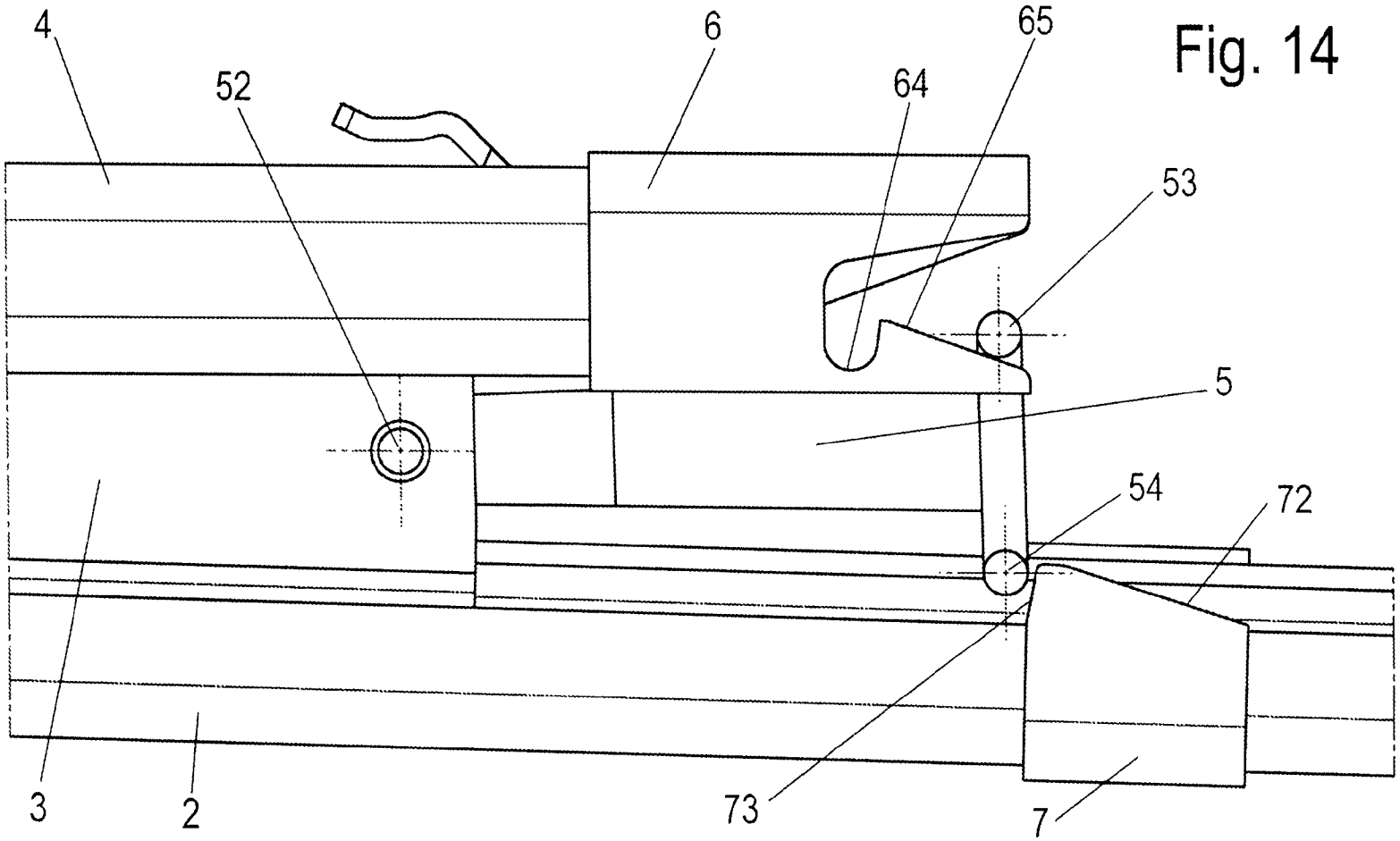

If the movable furniture or household appliance part is to be retracted again to its initial end position in the furniture or appliance body, the running rail 4 is pushed at first on the central rail 3 against the pull-out direction x in the direction of the furniture or appliance body. In this state, as shown in FIG. 13, the central rail 3 is still locked with the guide rail 2 by the locking element 5. Once the latching element 6 fixed to the running rail 4 has reached the locking element 5, and particularly the upper web 53, the upper web 53 slides upwardly on the ramp 65 of the latching element 6 against the pull-out direction x, as shown in FIG. 14, during further insertion of the running rail 4, so that a rear part of the locking element 5 is lifted and the locking of the central rail 3 in relation to the guide rail 2 is released. At the same time, the upper pin 53 moves into the latching groove 64 of the latching element 6 during further insertion of the running rail 4 and thereby latches the running rail 4 with the central rail 3 and thereby moves freely into the end position locked together with the running rail 4 as a result of the guide rail 2 which is mounted in a descending manner against the pull-out direction x.

Figure 3:
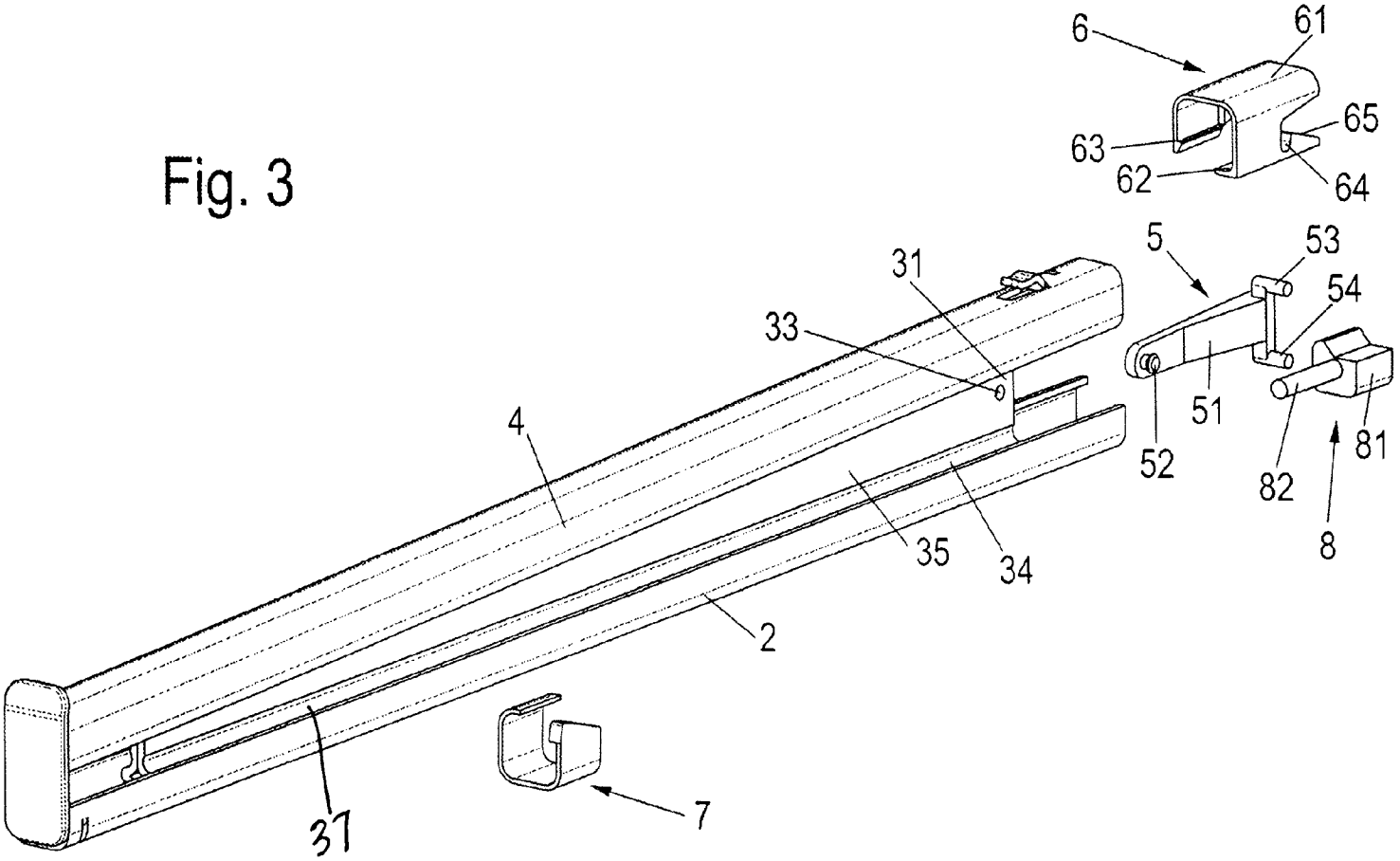
FIG. 3 shows a further exploded view of the pull-out guide of FIG. 1 including a stop damper.
Figure 4:
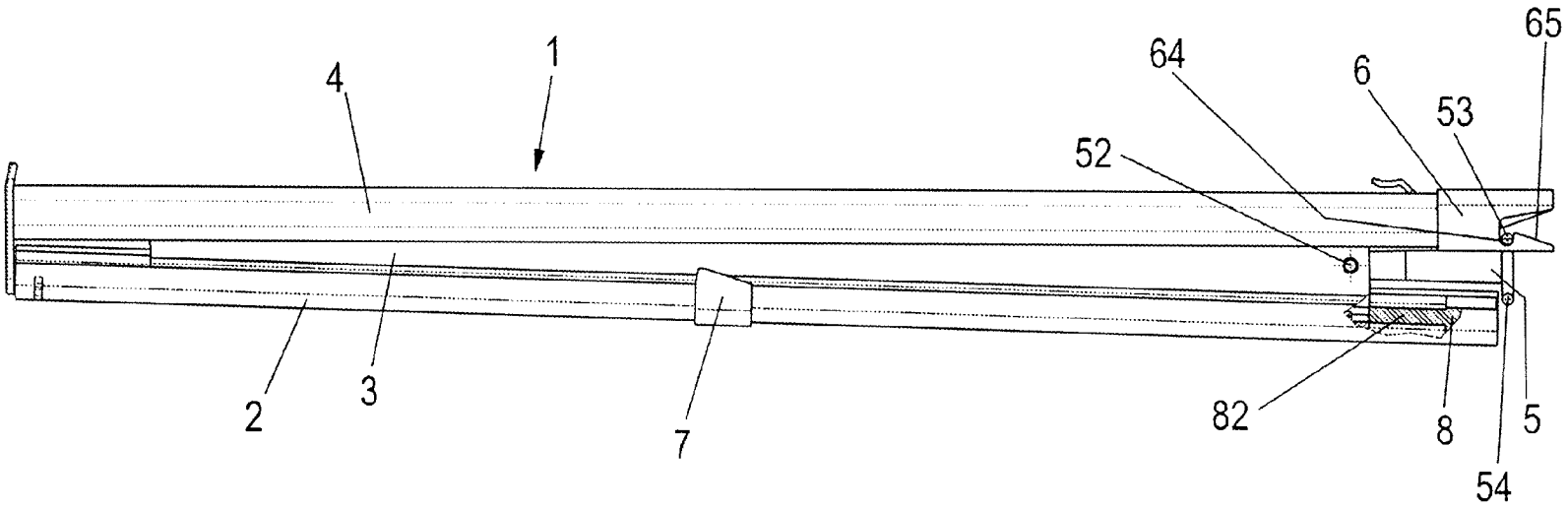
FIG. 4 shows a side view of the pull-out guide of FIG. 3, including a partly exposed guide rail showing the stop damper.

In order to dampen an impact of a face side of the rear end 31 of the central rail 3 on the stop in the guide rail 2, a stop damper 8 is provided on the rear end 21 of the guide rail 2, in accordance with the embodiment shown in FIGS. 3 and 4. The stop damper 8 may include, for example, a base body 81 which is adjusted to or configured to fit into an inner contour of the guide rail 2. From the base body 81, a spring element 82 and/or a damping element protrudes in the pull-out direction x and against which spring element 82 the face side of the rear end 31 of the central rail 3 will strike during retraction of the central rail 3 to the end position.

Although the present disclosure has been described and illustrated in detail, it is to be clearly understood that this is done by way of illustration and example only and is not to be taken by way of limitation. The scope of the present disclosure is to be limited only by the terms of the appended claims.

I claim:

1. A pull-out guide for furniture or household appliances, the pull-out guide comprising:

a guide rail configured to be mounted on a body of the furniture or the household appliance;

a central rail displaceably mounted on the guide rail;

a running rail displaceably mounted on the central rail; and wherein the central rail in overall extent is configured as a trapezoid along a displacement direction of the central rail; wherein the central rail includes a first profile which is displaceable in the running rail, a second profile which is displaceable in the guide rail, and a web which defines the trapezoidal shape of the central rail and connects the two profiles with one another, and a first width of the web located at a first end of the web is larger than a second width of the web located at a second end of the web; and wherein the first end is located at a rear end of the web and the second end is located at a front end of the web.

2. The pull-out guide according to claim 1, wherein the pull-out guide includes a locking arrangement configured to lock the running rail relative to the central rail at least over a portion of a pull-out path of the pull-out guide.

3. The pull-out guide according to claim 2, wherein the locking arrangement includes a locking element configured to be fastened to the central rail, a latching element configured to be fastened to the running rail, and a control element configured to be fastened to the guide rail, and further wherein the locking element is configured to be latched into the latching element or unlatched from the latching element when travelling over the control element.

4. The pull-out guide according to claim 3, wherein the locking element is configured as a ratchet pawl that is configured to be latched together with the latching element as a detent lug.

5. The pull-out guide according to claim 3, wherein the locking element is configured as a ratchet pawl that is rotatably fixed to the central rail.

6. The pull-out guide according to claim 3, wherein the locking element is configured as a ratchet pawl that is fixed in a spring-loaded manner to the central rail.

7. The pull-out guide according to claim 3, wherein the control element is configured as a ramp ascending in the pull-out direction.

8. The pull-out guide according to claim 1, further comprising a stop damper located at an end of the guide rail which is located closer to the first end of the web than to the second end of the web.

9. The pull-out guide according to claim 1, wherein the web includes gaps.

10. A pull-out guide for furniture or household appliances, the pull-out guide comprising:

a guide rail configured to be mounted on a body of the furniture or the household appliance;

a central rail displaceably mounted on the guide rail via first surfaces configured to accommodate rolling bodies;

a running rail displaceably mounted on the central rail via second surfaces configured to accommodate rolling bodies;

wherein at least a portion of the second surfaces are inclined with respect to at least a portion of the first surfaces; wherein the central rail includes a first profile which is displaceable in the guide rail and defines the first surfaces, a second profile which is displaceable in the running rail and defines the second surfaces, and a web which defines the trapezoidal shape of the central rail and connects the two profiles with one another, and a first width of the web located at a first end of the web is larger than a second width of the web located at a second end of the web; and wherein the first end is located at a rear end of the web and the second end is located at a front end of the web.

11. The pull-out guide of claim 10, wherein the first and second surfaces are configured as running surfaces.

* * * * *